US006447143B2

(12) United States Patent
Krietzman et al.

(10) Patent No.: US 6,447,143 B2
(45) Date of Patent: Sep. 10, 2002

(54) FLAT CREDIT CARD ILLUMINATOR WITH FLEXIBLE INTEGRAL SWITCHING ARM

(76) Inventors: Mark Howard Krietzman, P.O. Box 3185, Palos Verdes, CA (US) 90274; Yu-Hsin Chen, P.O. Box 3185, Palos Verdes, CA (US) 90274

( * ) Notice: Subject to any disclaimer, the term of this patent is extended or adjusted under 35 U.S.C. 154(b) by 0 days.

(21) Appl. No.: 09/740,472

(22) Filed: Dec. 19, 2000

Related U.S. Application Data

(60) Provisional application No. 60/172,985, filed on Dec. 20, 1999, provisional application No. 60/202,894, filed on May 10, 2000, and provisional application No. 60/253,188, filed on Nov. 27, 2000.

(51) Int. Cl.[7] ..... F21L 4/04

(52) U.S. Cl. ..... 362/200; 362/201; 362/184; 362/189

(58) Field of Search ..... 362/200, 201, 362/184, 189, 205

(56) References Cited

U.S. PATENT DOCUMENTS 6,302,570 B1 * 10/2001 Petell et al. ..... 362/554

* cited by examiner

*Primary Examiner*—Sandra O'Shea
*Assistant Examiner*—Ronald E. DelGizzi
(74) *Attorney, Agent, or Firm*—Mark Krietzman

(57) ABSTRACT

A flat card shaped illuminator with an on/off switch integrally formed therein. The flat card shaped light is adapted to a variety of uses and the on/off switch may be momentary or latching. One or more LEDs may be incorporated therein and the batteries may be removable.

26 Claims, 6 Drawing Sheets

FLAT CREDIT CARD ILLUMINATOR WITH FLEXIBLE INTEGRAL SWITCHING ARM

RELATED APPLICATIONS

The invention claims the benefit, under Title 35, United States Code 119 (e), of Provisional Applications: No. 60/172,985, filed Dec. 20, 1999, entitled "Flat Illuminator", No. 60/202,894, filed May 10, 2000, entitled "Flat Illuminator"; and, No. 60/253,188, file Nov. 27, 2000, entitled "Flat Illuminator".

BACKGROUND OF THE INVENTION

1. Field of The Invention

This present invention relates to a credit card sized flashlight with a flat surface. More particularly to a plastic card light which illuminates with one or more light-emitting diodes "LED" with a horizontal pressure switch formed integrally within an edge which does not exceed beyond the thickness of the plastic body.

2. The Prior Art

A recent card light found in U.S. Pat. No. 6,070,990 assigned to the Eveready Battery Company illustrates how a single "button" battery may be sandwiched between the anode and cathode of a circular LED integrated into a switching mechanism. The circular LED protrudes beyond the top and bottom edges of the card light encasement Another prior art planar flashlight is found in U.S. Pat. No. 5,934,789, issued to Sinclair et. al., which teaches a large relatively planar disposable flashlight. The Sinclair flashlight uses is the size of a deck of playing card and will not fit in the credit card slot of a wallet.

SUMMARY OF INVENTION

The invention herein is a truly flat credit card flashlight. The card light may be disposable with the battery supply fixed within the card light housing (FIGS. 1 & 2) or the card light may have replaceable batteries with a slot, panel or door allowing access to the battery supply (FIGS. 4,6 & 7). The nature of the plastic body forming the card light is taken into account when forming a horizontal on/off switch from a flexible switching arm extending in plane from the flat plastic body and which does not extend beyond the thickness of the plastic body. The switch may also latch (FIGS. 5 & 7) for a constant "on" mode. Within the scope of the invention is the use of multiple LEDs and a variety of battery configurations . Advertising and/or information may be stenciled onto the flat card light (FIG. 1) and magnets (FIG. 3A) may be incorporated into the body for mounting or hands free operation.

The features of the invention believed to be novel are set forth with particularity in the appended claim. The invention itself, however, both as to configuration, and method of operation, and the advantages thereof, may be best understood by reference to the following specification, abstract, claims and accompanying drawings.

BRIEF DESCRIPTION OF THE DRAWINGS

FIG. 1C is a rear view of the preferred embodiment.

DETAILED DESCRIPTIONS OF THE PREFERRED EMBODIMENTS

Figure 1A:
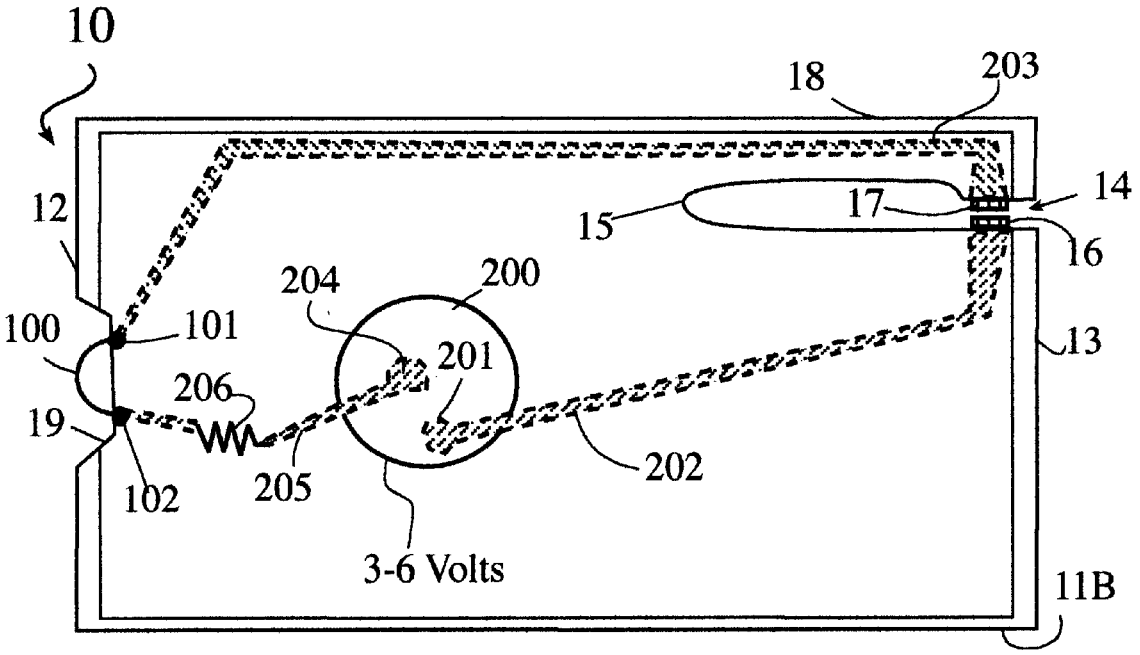
FIG. 1A is a top view of the preferred embodiment of the flat card light.
Figure 1B:
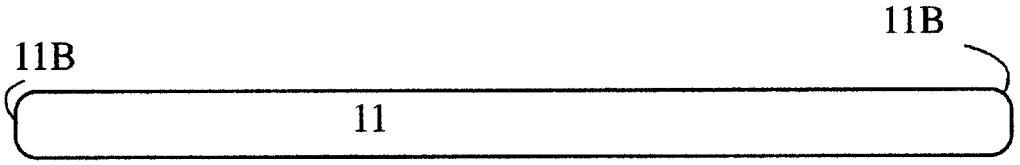
FIG. 1B is a side view of the preferred embodiment.
Figure 1B:
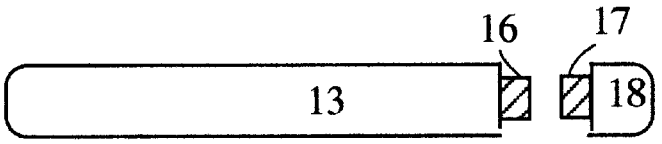
Figure 1D:
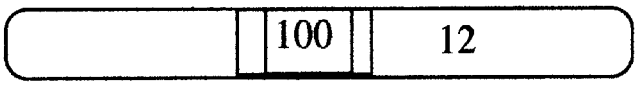
FIG. 1D is a front view of the preferred embodiment.

Illustrated in FIGS. 1A,1B, 1C and 1D, are top, front, rear and side views of the preferred embodiment of the flat card light generally designated 10 and constructed on a planar plastic body 11A with an edge thickness between about 1.0 mm and about 3.5 mm, tapered or beveled around some or all of the periphery 11B and shaped to fit within the credit card slot of a wallet and has a front edge 12 and a back edge 13. Formed integrally in the back edge 13 is a horizontal pressure switch 14. The horizontal pressure switch 14 lays flat and does not exceed the thickness of the plastic body 11A. A switch guide 15 is formed, or die-cut, in a portion of the plastic body 11A and the periphery 11B , forming a flexible switching arm 18, of the horizontal pressure switch 14, which extends from the plastic body 11A . A first switch contact 16 is affixed to the flexible switching arm 18 and a second switch contact 17 is affixed on opposite side of the switch guide 15. The flexible switching arm 18 is sufficiently flexible whereby the first switching contact 16 may be placed into contact with the second switching contact 17 by momentarily displacing the flexible switching arm 18. The first and second switching contacts 16 and 17 are formed of a metallic material suitable for conducting electricity such as tin, steel, iron, copper, brass, or titanium. A light well 19 may also be formed in the front edge 12 wherein a LED 100 is affixed. A flat LED for use with the flat illuminator is an "ESM-3070" series LED, manufactured by Elekon Industries, in Torrance, Calif., which has a side thickness of 1.2 millimeters. LEDs or light-emitting diodes 100 are common in the industry and no specific LED is called out for, and any low profile LED which produces an output in the visible spectrum is contemplated.

The power supply for the flat illuminator is a "button" type lithium battery 200 such as a CR 2016, or CR 2405, manufactured by Matsushita Electric Corporation of America (Panasonic). In this preferred embodiment a stacked pair of CR 2405 batteries yield a nominal voltage of 6 volts with a current of 28 milliamperes. A first battery contact 201 placed against the negative terminal of the battery is conductively linked to the first switch contact 16 by a first conductive strip 202. A second conductive strip 203 is attached to the second switch contact 17 at one end and to a first LED contact 101 of the LED 100 at its other end. The second LED contact 102 is attached to the a battery's positive terminal at the second battery contact 204 via a third contact strip 205.

Figure 2:
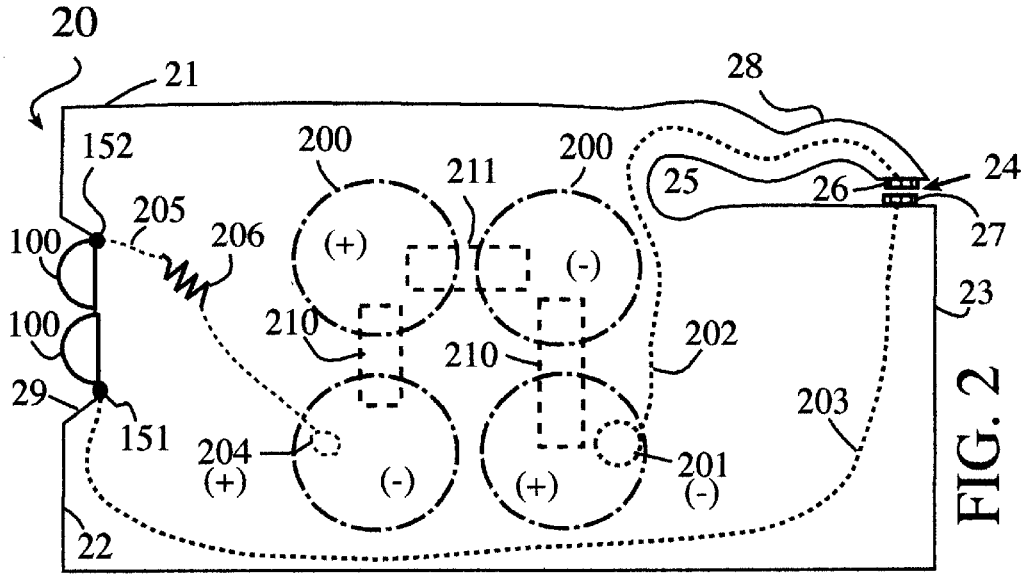
FIG. 2 is a top view of a first alternate embodiment of the flat card light.

As noted above a pair CR 2016 battery may be used in place of the pair of CR 2405 batteries, however due to the thickness of the CR 2016 batteries the pair should be placed side by side within the casing as shown in FIG. 2. The CR 2016 battery yield a nominal forward current 90 milliamperes. A 90 milliamperes forward current may exceed the maximum 60 milliamperes forward current of the "ESM-3070" LED 100, therefore a resistor 206 should be integrated into the third contact strip to limit the current.

Illustrated in FIG. 2 is a first alternate embodiment of the flat card light generally designated 20. The flat card light is constructed of a planar plastic body 21 with an edge thickness between about 1.0 mm and about 3.5 mm and shaped to fit within the credit card slot of a wallet and has a front edge 22 and a back edge 23. A horizontal pressure switch 24 is formed integrally in the planar plastic body. The horizontal pressure switch 24 lays flat and does not exceed the thickness of the plastic body 21. A switch guide 25 is formed, or die-cut, in a portion of the plastic body 21 thereby forming a flexible shaped switching arm 28 which extends from the plastic body 21 . A first switch contact 26 and a second switch contact 27 are affixed on opposite side of the switch guide 25. The first switch contact 26 being affixed to the shaped switching arm 28. The shaped switching arm 28 is sufficiently flexible along its length whereby the shaped switching arm 28, with the first switch contact 26 thereon, may be momentarily displaced to bring the first switch contact 26 into contact with the second switching contact 27 thereby powering the LED array 150. A light guide 29 may be formed on the front edge 22 wherein the LED array 150 is affixed.

The power supply for the light is a group of "button" type lithium battery 200. In this first alternate embodiment four CR 2016 batteries with a combined nominal voltage of 12 volts with a current of 90 milliamperes are connected in series via a pair of upper contact strips 210 and a lower contact strip 211. To power the LED array 150 a first battery contact 201 is placed against the negative terminal of the battery and conductively linked to the first switch contact 26 by a first conductive strip 202. A second conductive strip 203 is attached to the second switch contact 27 at one end and to a first LED array contact 151 at its other end. The second LED array contact 152 is attached to the a battery's positive terminal at the second battery contact 204 via a third contact strip 205 a resistor 206 may be integrated into the third contact strip 205 to limit the current to the LED array 150.

Figure 3A:
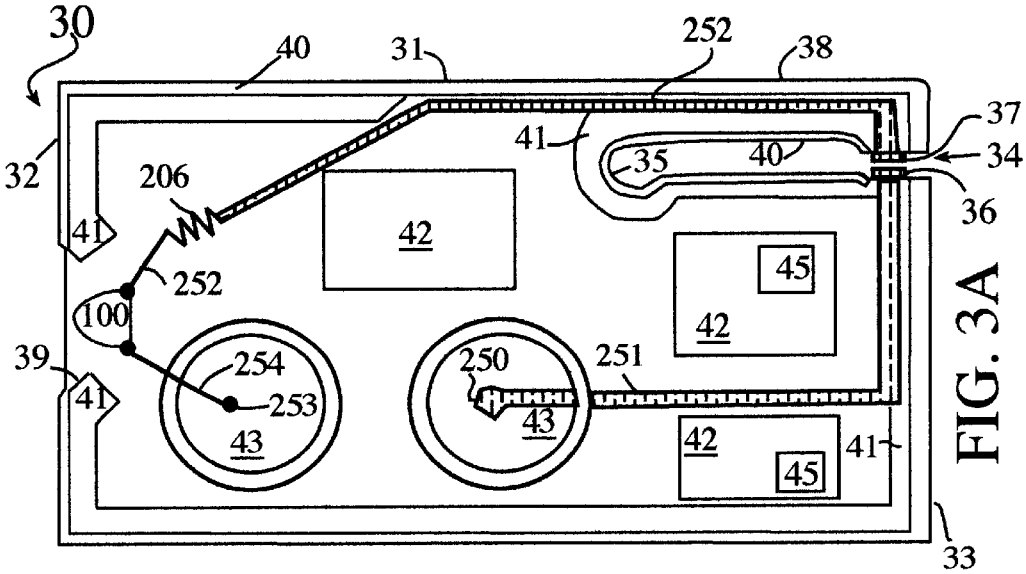
FIG. 3A is a top view of an uncovered second alternate embodiment of the flat card light.
Figure 3B:
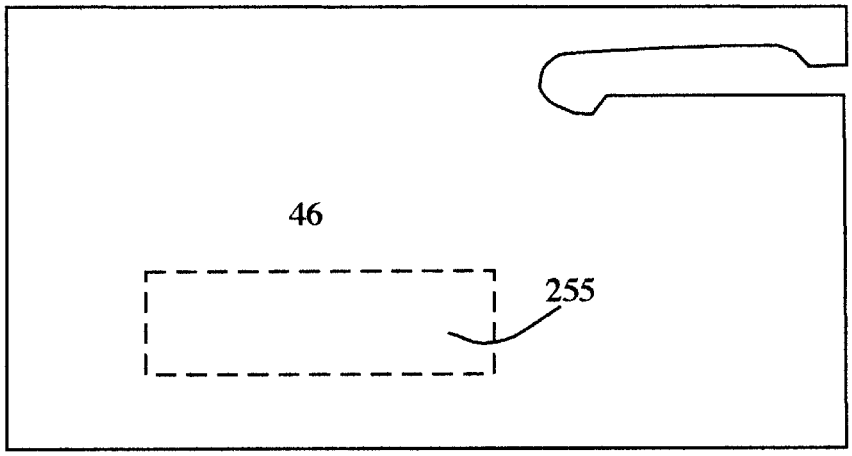
FIG. 3B is a top view of the cover for the embodiment of FIG. 3A.

Shown in FIGS. 3A and 3B are the body cavity and cover of a second alternate embodiment of the flat card light generally designated 30 and constructed within a plastic cavity body 31 with an edge thickness between about 1.0 mm and about 3.5 mm and shaped to fit within the credit card slot of a wallet. The plastic cavity body 31 has a front edge 32 and a back edge 33, with a flexible pressure switch 34 integrally formed therein. The flexible pressure switch 34 lays flat and does not exceed the thickness of the body 31. A switch guide 35 is formed, or die-cut, in a portion of the plastic cavity body 31 providing a switching arm 38 extending from the plastic cavity body 31. A first switch contact 36 and a second switch contact 37 are affixed on opposite side of the switch guide 35. The switching arm 38 is sufficiently flexible, along its length, whereby the switching arm 38, with the first switch contact 36 thereon, may be momentarily displaced to bring the first switch contact 36 into contact with the second switching contact 37 thereby powering the LED 100. A light guide 39 may be formed on the front edge 32 where the LED 100 is affixed.

Forming the thickest portion of the plastic cavity body 31 is a raised edge 40 which substantially surrounds the plastic cavity body 31, adjacent to substantially all of the raised edge 40, and inside the plastic body 31, is a inset shelf 41 of a height whereby a supported cover will be aligned with the raised edge 40. Also within the plastic cavity body 31 are several cover supports 42 of a height whereby a supported cover will be aligned with the raised edge 40. Battery wells 43 are formed by a surrounding well walls 44 of a height whereby a supported cover will be aligned with the raised edge 40. A group of magnets 45 may also be affixed through the plastic cavity body 31. A cover 46 of a size and shape to mate with the plastic cavity body 31 is used to cover the plastic cavity body 31.

The power supply for the LED 100 is a pair of "button" type lithium battery (not shown) which are placed in the battery wells 43. A first battery contact 250 rests against the negative terminal of the battery, which is conductively linked to the first switch contact 36 by a first conductive strip 251. A second conductive strip 252 is attached to the second switch contact 37 at one end and to a first LED contact 101 at its other end. The second LED contact 102 is attached to the battery's positive terminal at the second battery contact 253 via a third contact strip 254. A resistor 206 may be integrated into the second contact strip 252 to limit the current to the LED 100. To serially connect the batteries (not shown) they are placed into the battery wells 43 and a cover contact 255 is affixed to the inside face of the cover 46 adapted to engage the top terminal of each battery 200 in each well 43.

Figure 4:
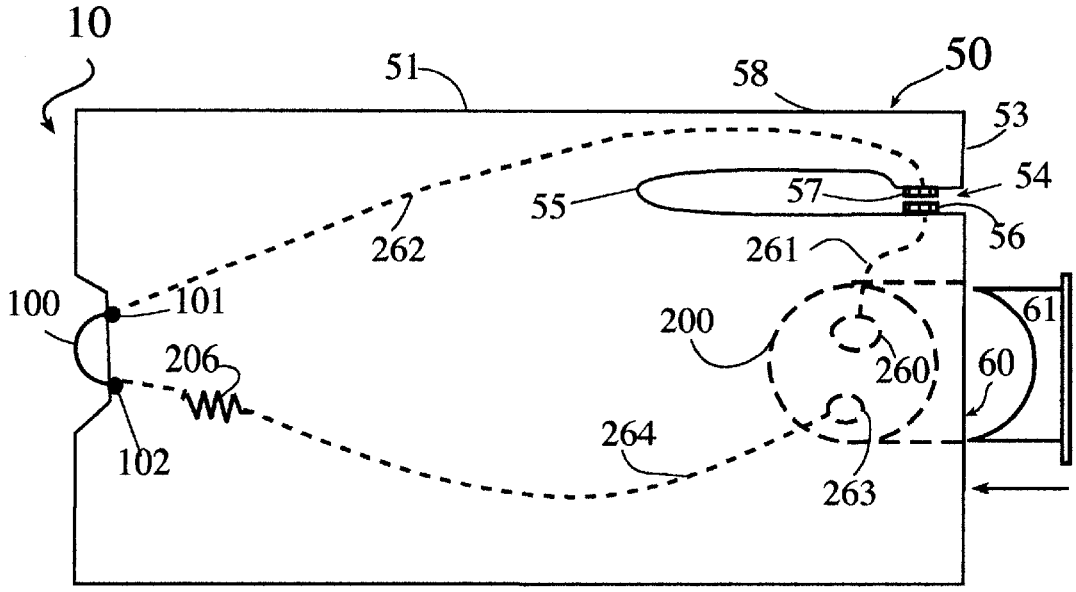
FIG. 4 is a top view of a third alternate embodiment of the flat card light.

Shown in FIG. 4 is a third alternate embodiment of the flat card light generally designated 50 which is constructed around a planar plastic body 51 with a thickness between about 1.0 mm and about 3.5 mm and shaped to fit within the credit card slot of a wallet. The plastic body 51 has a front edge 52, a back edge 53, and a horizontal pressure switch 54 formed integrally in the back edge 53. The horizontal pressure switch 54 lays flat and does not exceed the thickness of the plastic body 51. A switch guide 55 is formed, or die-cut in, through a portion of the plastic body 51 providing a flexible switching arm 58 extending from the plastic body 51. A first switch contact 56 and a second switch contact 57 are affixed on opposite side of the switch guide 55. The flexible switching arm 58 is sufficiently flexible, along its length, whereby the switching arm 58, with the first switch contact 56 thereon, may be momentarily displaced to bring the first switch contact 56 into contact with the second switching contact 57 thereby powering the LED 100.

The power supply for the light is a "button" type lithium battery 200 such as a pair of CR 2405, manufactured by Matsushita Electric Corporation of America (Panasonic) with a combined nominal voltage of 6 volts at 28 milliamperes stacked together with a first battery contact 260 against the negative terminal of the battery 200 and conductively linked to the first switch contact 56 by a first conductive strip 261. A second conductive strip 262 is attached to the second switch contact 57 at one end and to a first LED contact 101 at its other end. The second LED contact 102 is attached to the a battery's positive terminal at the second battery contact 263 via a third contact strip 264. A resistor 206 may be integrated into the third contact strip 264 to limit the current to the LED 100.

The battery in this configuration is replaceable and is seated in a battery chamber 59 formed within the plastic body 51 with an entry way 60 at the back edge 53 and a removably door 61 of a size and shape to removably mate with the entry way 60.

Figure 5A:
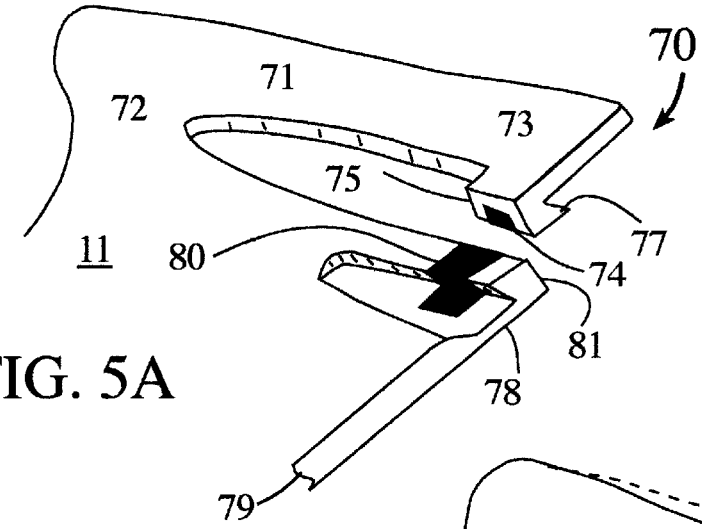
FIG. 5A is a perspective view of a first latching switch for the flat card light in the "off" position.
Figure 5B:
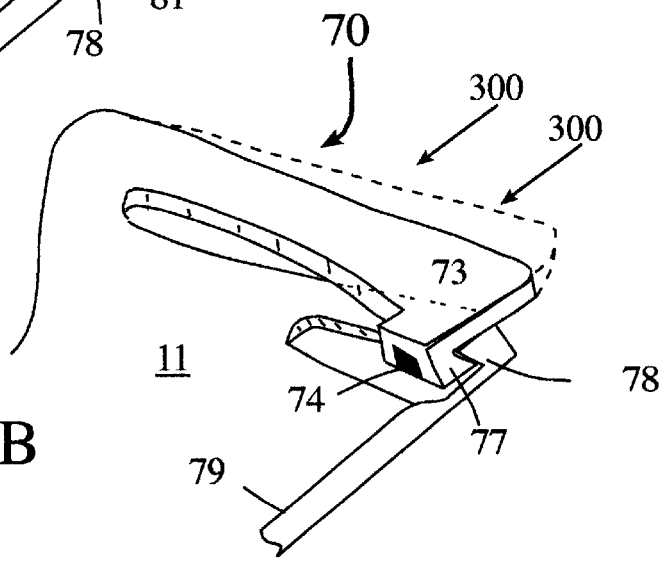
FIG. 5B is a perspective view of the latching of FIG. 5A in the "on" position.

The card light may be operated through the momentary engagement of the switch contacts 56 and 57 via the horizontal movement of the pressure switch (FIGS. 1–4) or the pressure switch may be shaped to yield a latching function thereby allowing a fixed "on" mode until such latched switch is unlatched. Shown in FIGS. 5A and 5B is a perspective view of a first embodiment of a latching switch in the "on" and the "off" positions, generally designated 70. The flexible switching arm 71 at one end 72 extends substantially in plane from the plastic body 11 of a flat card light and has a free end 73. A first switch contact 74 is affixed both to the first momentary face 75 and the underside 76 of the free end 73, a latching hook 77 is also formed on the underside 76 of the free end 73 adjacent to the first switch contact 74. The latching hook 77 fits into a corresponding switch catch 78 formed on the edge 79 of the plastic body 11 opposite the latching hook 77 and connects to second switch contact 80 to the first switch contact 74 (FIG. 5B) thereby switching the flat illuminator "on". The second switch contact 80 covers a portion of the second momentary face 81. By contacting the two momentary faces 75 & 81 together, via moving the flexible switching arm toward the switching catch 78 along the line of arrow 300 the circuit (shown in FIGS. 1–4, 6&7) may be closed and power supplied to an LED.

Shown in FIG. 5B is the placement of the latching hook 77 within the switch catch 78 which connects the first and second switch contacts 74 & 80 together thereby switching on the circuit and supplying current to the LED.

Figure 6:
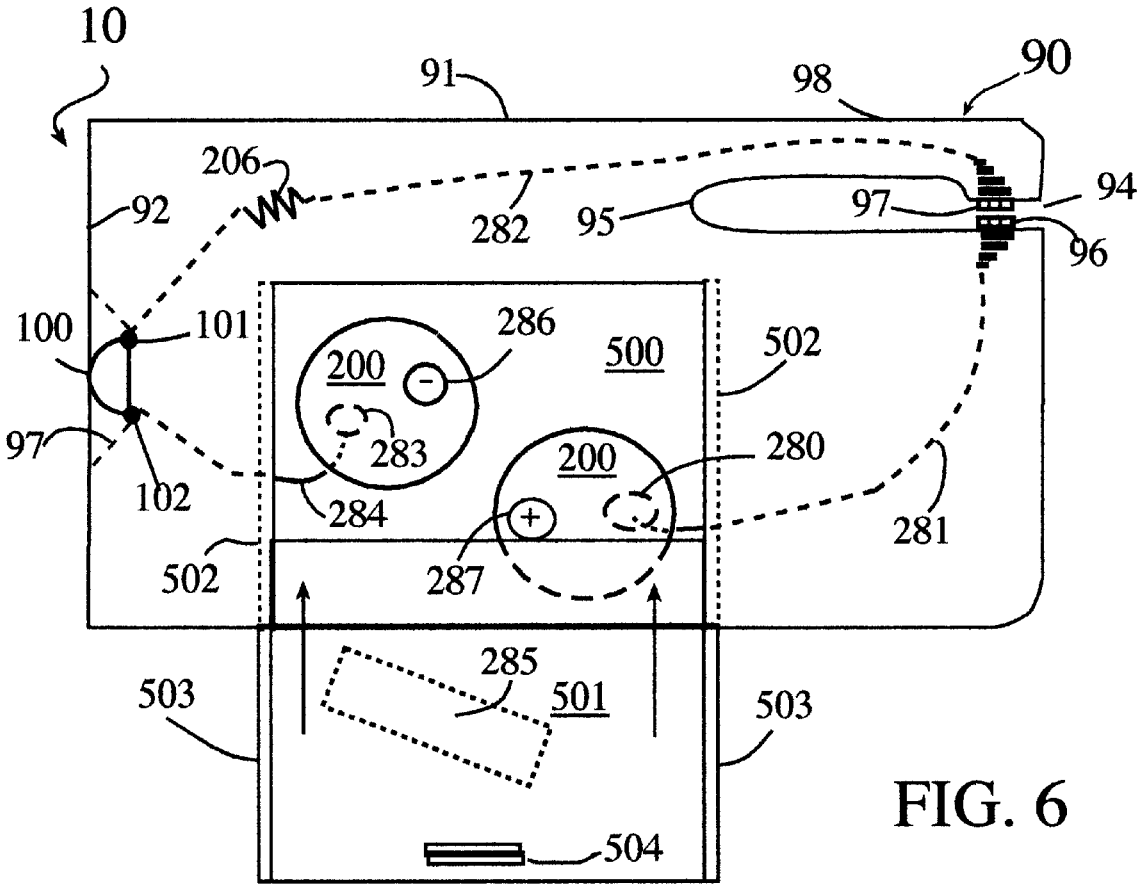
FIG. 6 is a perspective view of a fourth alternate embodiment of the flat card light.

A fourth alternate embodiment of the flat card light 90 is shown in FIG. 6. The flat card light 90 is constructed around a planar plastic body 91 with a thickness between about 1.0 millimeters and about 3.5 millimeters and shaped to fit within the credit card slot of a wallet. The plastic body 91 has a front edge 92 and a back edge 93. A horizontal pressure switch 94 is formed integrally in the plastic body 91. The horizontal pressure switch 94 lays flat and does not exceed the thickness of the plastic body 91. A switch guide 95 is formed, or die-cut in, through a portion of the plastic body 91 providing a flexible switching arm 98 extending from the plastic body 91. A first switch contact 96 and a second switch contact 97 are affixed on opposite side of the switch guide 95. The flexible switching arm 98 is sufficiently flexible, whereby the switching arm 98, with the first switch contact 96 thereon, may be momentarily displaced to bring the first switch contact 96 into contact with the second switching contact 97 thereby powering the LED 100. A light well 99 is also be formed in the front edge 92 wherein a flat LED 100 is affixed.

The power supply is placed within a inset battery chamber 500 formed within the plastic body 91. The battery chamber is open at the edge of the plastic body 91 so that a sliding door 501, may be removably inserted to cover the battery chamber 500. Along two opposite edges of the battery chamber 500 are slide guides 502 into which fit the shaped edges 503 of the sliding door 501, a textured finger pad 504 is formed on the outside of the sliding door 501 to assist removal of the sliding door 501.

The power supply for the light is a pair of "button" type lithium battery 200 such as a CR 2016, or CR 2405, manufactured by Matsushita Electric Corporation of America (Panasonic). In this embodiment a pair of CR 2405 batteries with a combined nominal voltage of 6 volts, and a current of 28 milliamperes, are connected in series. A first battery contact 280 is placed against the negative terminal of the battery and conductively linked to the first switch contact 96 by a first conductive strip 281. A second conductive strip 282 is attached to the second switch contact 97 at one end and to a first LED contact 101 at its other end. The second LED contact 102 is attached to the a battery's positive terminal at the second battery contact 283 via a third contact strip 284. To complete the connections a door contact 285 is affixed to the inside face of the sliding door whereby the top battery terminals 286 & 287 are connected.

A pair of CR 2016 batteries may be used in place of the pair of CR 2405 batteries, this will yield a combined nominal 6 volts and a current of 90 milliamperes. When using a the CR 2016 batteries, the current may exceed the forward current of the LED 100 and a resistor 206 should be integrated into the second contact strip 282 to limit the current.

A fifth alternate embodiment of the flat card light, shown in FIGS. 7A–7E, generally designated 110, is constructed around a planar plastic body 111 of a thickness between about 1.0 millimeters and about 3.5 millimeters and shaped to fit within the credit card slot of a wallet. The plastic planar has a front edge 112 and a back edge 133. A dual function pressure switch 114 is formed integrally within the planar plastic body 111. A switch guide 115 is formed, or die-cut, in a portion of the plastic body 111 providing a flexible switching arm 118 extending from the plastic body 1111. A first switch contact 116 and a second switch contact 117 are affixed on opposite side of the switch guide 115.

To switch "on" and "off" the LED 100 the flexible switching arm 118 is sufficiently flexible whereby the switching arm 118 with the first switch contact 116 thereon (FIG. 7C) may be displaced. For momentary activation of the LED 100, the angular contact edge 300 of the first switch contact 116 is moved by the displacement of the switching arm 118 against the angular contact edge 301 of the second switching contact 117 (FIG. 7D) thereby momentarily powering the LED 100. To latch the LED 100 "on" (FIG. 7E) the flexible switching arm 118 is displaced sufficiently to urge the angular contact edges 301 & 302 past each other, whereby when the displacement ceases the angular contact edges 300 & 301 catch each other.

Figure 7A:
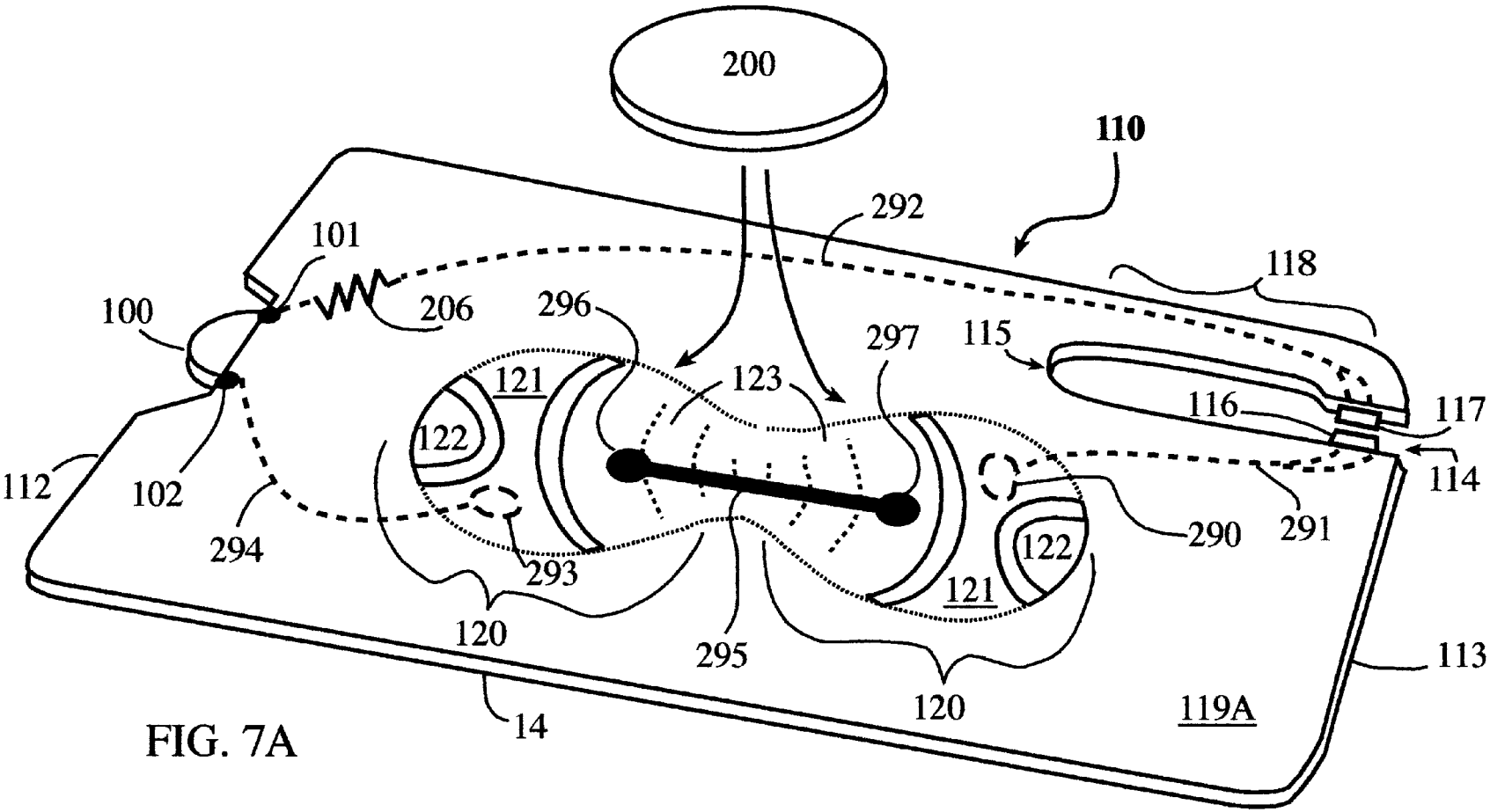
FIG. 7A is a top perspective view of a fifth alternate embodiment of the flat card light.
Figure 7B:
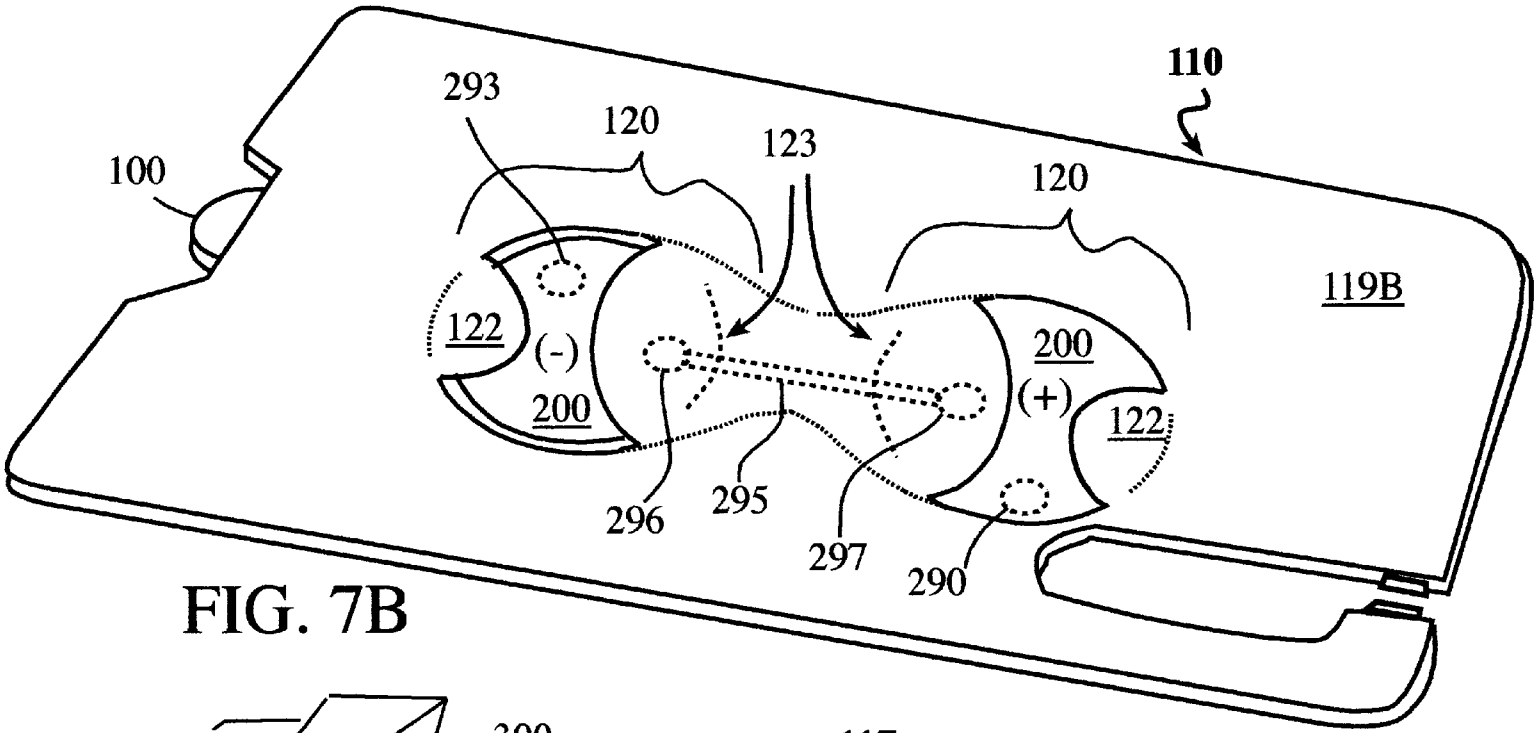
FIG. 7B is a bottom perspective view of the embodiment of FIG. 7A.
Figure 7C:
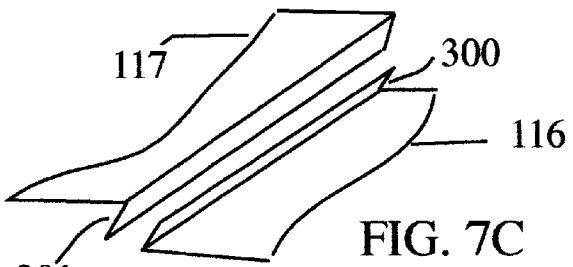
FIG. 7C is a close-up view of the embodiment of FIG. 7A showing a second embodiment of a latching switch.
Figure 7D:
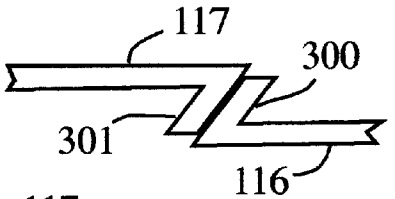
FIG. 7D is a close-up view of the embodiment of FIG. 7C in the momentary "on" position.
Figure 7E:
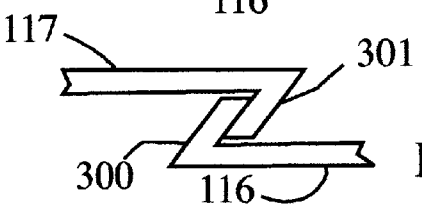
FIG. 7E is a close-up view of the embodiment of FIG. 7C in the latched "on" position.

Each battery 200 of the power supply is mounted through the top face 119A of the plastic body 111 within an inset battery holster 120. The battery holster has a top stirrup 121 an under footing 122 and a loading ramp 123. In FIG. 7B the mounted batteries 200 can be seen partially visible through the bottom face 119B resting above the under footing 122, and loading ramp 123 and under the stirrup 121.

The power supply for the light is a pair of "button" type lithium battery 200 such as a CR 2016, or CR 2405, manufactured by Matsushita Electric Corporation of America (Panasonic). A first battery contact 290 is held against the negative terminal of the battery and conductively linked to the first switch contact 116 by a first conductive strip 291. A second conductive strip 292 is attached to the second switch contact 117 at one end and to a first LED contact 101 at its other end. The second LED contact 102 is attached to the battery's positive terminal at the second battery contact 293 via a third contact strip 294. To complete the connections a body contact 295 is affixed between the two loading ramps 123 with a first link contact 296 attaching the negative terminal of one battery 200 to the positive terminal of the other battery 200.

Since certain changes may be made in the above apparatus without departing from the scope of the invention herein involved, it is intended that all matter contained in the above description, as shown in the accompanying drawing, the specification, and the claims shall be interpreted in an illustrative, and not a limiting sense.

What we claim is:

1. A flat illuminator comprising:

a flat substantially planar plastic body with a front face, a back face, and with an edge thickness less than about 3.5 millimeters;

one or more light emitting diodes (LEDs) affixed to, or within, the substantially planar plastic body;

a battery power supply with a positive and negative terminal mounted within said plastic body which does not protrude beyond the edge thickness and with one of the terminals conductively linked to the one or more light emitting diodes;

a horizontal pressure switch which comprises;

a flexible switching arm extending from the plastic body which does not exceed the thickness of the plastic body; and a series of contacts, at least one of which of is affixed to the flexible switching arm opposite another on the plastic body, whereby the battery terminal, not connected to the one or more light emitting diodes, can be connected by the displacement of the flexible switching arm and contacts affixed thereon, to the one or more light emitting diodes.

2. The flat illuminator of claim 1 in which the battery is a single lithium "button" battery between 10 mm–30 mm in diameter with a thickness between about 0.4 mm and about 0.3 mm.

3. The flat illuminator of claim 1 further comprising a resistor affixed between said battery and said one or more light emitting diodes.

4. The flat illuminator of claim 1 in which the battery power supply is two or more lithium "button" batteries connected in series with a total voltage between 6 and 48 volts.

5. The flat illuminator of claim 1 in wherein the wavelength of the light emitted by said one or more LEDs is substantially within one color of the visible spectral region.

6. The flat illuminator of claim 1 in wherein the wavelength of the one or more LEDs are all substantially in the blue spectral region.

7. The flat illuminator of claim 1 in wherein the wavelength of the one or more LEDs are all substantially in the non-visible spectral region.

8. The flat illuminator of claim 1 further comprising a lens formed integrally as part of each LED with a fan angle of between 4 and 20 degrees.

9. The flat illuminator card light of claim 1 wherein the battery power supply is non-removable.

10. The flat illuminator card light of claim 1 wherein the battery power supply is replaceable.

11. The flat illuminator card light of claim 10 further comprising:

a battery -receiving chamber formed in the edge of said plastic body, whereby the battery power supply is removably inserted; and, a cover which removable closes off the battery-receiving chamber.

12. The flat illuminator card light of claim 10 further comprising:

a battery-receiving well formed in one of said front face and said bottom faces whereby the battery power supply is removably inserted;

a cover which removable closes off said battery-receiving well; and, a cover contact which connects said battery power supply when the cover is closed.

13. The flat illuminator card light of claim 1, further comprising a magnet affixed to one side of the plastic body whereby the flat card light may be affixed to a metal surface.

14. A flat illuminator comprising:

a flat substantially flat and rectangular plastic body with an edge having a thickness between about 1.0 mm and about 3.5 mm;

one or more light emitting diodes (LED) affixed to, or within said edge which do extended or protrude beyond said edge thickness with an anode and cathode contact extending;

a lens formed integrally as part of said one or more light emitting diode which is at a fan angle of between 5 and 15 degrees;

a 6–12 volt button battery power supply mounted within said plastic body which does not protrude beyond said edge thickness;

an on/off switch further comprising:

a first switch contact which is conductively linked to a first battery contact on the positive terminal of said battery power supply;

a second switch contact which is conductively linked to said cathode contact of said one or more light emitting diodes;

a flexible leg supporting said second switch contact, whereby the movement of said flexible leg places the first and second switch contacts together; and, a second battery contact against the negative terminal of said battery power supply and conductively linked to said anode contact of said one or more light emitting diodes.

15. The flat illuminator of claim 14 wherein the on/off switch is dual function and able to act as a momentary switch or a steady "on" switch.

16. The flat illuminator of claim 15 wherein the on/off switch further comprises an angular contact edge extending from said first and second switch contacts, whereby the angular contact edges are angled backwards and are adapted to be placed either in momentary contact or urged past one another and caught in an "on" position.

17. The flat illuminator of claim 15 wherein the on/off switch further comprising:

a latching hook formed on said flexible switching arm; and, a switch catch formed on said plastic body adapted to receive the latching hook.

18. The flat illuminator of claim 14 further comprising a resistor affixed between said lithium battery power supply and said one or more light emitting diodes.

19. The flat illuminator of claim 14 wherein the wavelength of said one or more light emitting diodes is substantially in the visible spectral region.

20. The flat card light of claim 14 wherein the lithium battery power supply is two stacked batteries with a diameter between 15–30 mm diameter and a thickness between about 0.4 mm–0.5 mm connected to one LED.

21. The flat card light of claim 14 wherein the lithium battery power supply is two side by side batteries with a diameter between 10 mm–35 mm diameter and a thickness between 0.4 mm–3.0 mm connected to one LED.

22. The flat illuminator card light of claim 14 wherein the battery power supply is removably mounted within said plastic body.

23. The flat illuminator card light of claim 14 wherein said edge is tapered, whereby the card light is more easily slipped into a wallet.

24. A flat credit card shaped illuminator comprising:

a substantially planar plastic body with a substantially rectangular bottom face;

a side wall formed around said bottom face with a thickness less than about 3.5 mm, forming an open cavity;

one or more light emitting diodes (LED) affixed to said plastic body with an anode and a cathode contact extending into the open cavity;

a button battery power supply mounted removably within the plastic body;

a first switch contact conductively linked to the positive terminal of said button battery power supply:

a second switch contact conductively linked to the cathode contact a flexible switching arm extending from the plastic body supporting the second switch contact, whereby the movement of said flexible arm momentarily places the first and second switch contacts together;

the anode contact conductively linked to the negative terminal of the button battery power supply;

a flat cover which closes off the open cavity.

25. The flat credit card shaped illuminator card light of claim 23 wherein said flat cover is removably affixed, whereby the battery power supply may be replaced.

26. The flat illuminator of claim 14 wherein information may be stenciled on to said plastic body.

* * * * *